US010859315B2

(12) United States Patent
Mitchell

(10) Patent No.: US 10,859,315 B2
(45) Date of Patent: Dec. 8, 2020

(54) SYSTEM WITH A CEILING FAN AND RETURN PLENUM FOR HEATING, DRYING OR CURING AN OBJECT

(75) Inventor: Jeffrey C. Mitchell, East Troy, WI (US)

(73) Assignee: LAX Engineered Solutions LLC, Waukesha, WI (US)

( * ) Notice: Subject to any disclaimer, the term of this patent is extended or adjusted under 35 U.S.C. 154(b) by 0 days.

(21) Appl. No.: 13/340,186

(22) Filed: Dec. 29, 2011

(65) Prior Publication Data

US 2013/0167396 A1 Jul. 4, 2013

(51) Int. Cl.

| | |
|---|---|
| ***F26B 19/00*** | (2006.01) |
| ***F26B 21/02*** | (2006.01) |
| ***F26B 25/06*** | (2006.01) |
| ***F26B 21/12*** | (2006.01) |
| *F26B 23/04* | (2006.01) |
| *F26B 23/02* | (2006.01) |

(52) U.S. Cl.

CPC ..... *F26B 21/026* (2013.01); *F26B 21/12* (2013.01); *F26B 25/06* (2013.01); *F26B 23/022* (2013.01); *F26B 23/04* (2013.01)

(58) Field of Classification Search

CPC ..... F26B 21/02; B05D 3/046; D06F 58/10; F24C 15/322; F27B 9/04; F27B 9/045

USPC ..... 34/223

See application file for complete search history.

(56) References Cited

U.S. PATENT DOCUMENTS

| | | | | |
|---|---|---|---|---|
| 5,099,587 | A * | 3/1992 | Jarosch | 34/202 |
| 5,588,830 | A * | 12/1996 | Josefsson | F26B 3/283 34/476 |
| 5,657,555 | A * | 8/1997 | Milojevic et al. | 34/271 |
| 6,015,288 | A * | 1/2000 | Mundon | C03B 25/06 432/212 |
| 6,148,539 | A * | 11/2000 | Hatfield et al. | 34/223 |
| 7,045,013 | B2 | 5/2006 | DeRegge | |
| 7,264,467 | B1 * | 9/2007 | Mitchell | F27B 17/0016 34/270 |
| 2004/0237339 | A1 * | 12/2004 | Sonner et al. | 34/666 |
| 2005/0120948 | A1 * | 6/2005 | DeRegge | F26B 21/003 118/312 |
| 2009/0017408 | A1 * | 1/2009 | Pakkala et al. | 432/145 |
| 2010/0058608 | A1 * | 3/2010 | Moon et al. | 34/282 |
| 2010/0301034 | A1 * | 12/2010 | Greenwood et al. | 219/400 |

* cited by examiner

*Primary Examiner* — Jason Lau

(74) *Attorney, Agent, or Firm* — Boyle Fredrickson, SC

(57) ABSTRACT

A system for heating, drying or curing an object, the system comprising a housing having a first wall and at least one second wall adjacent the first wall. The first wall and at least one second wall define an interior for holding an object to be heated, dried or cured. The system also includes an air plenum adjacent to, covering and disposed inward from the first wall, and at least one air plenum opening in the air plenum to supply air into the interior. A fan is disposed in the one air plenum opening. The system also includes a ductwork assembly adjacent to, covering and disposed inward from the second wall. The ductwork assembly is in air-communication with the air plenum, and has a ductwork opening so that substantially all air circulation in the interior is between the air plenum opening and the ductwork opening.

21 Claims, 5 Drawing Sheets

SYSTEM WITH A CEILING FAN AND RETURN PLENUM FOR HEATING, DRYING OR CURING AN OBJECT

BACKGROUND

This disclosure relates to the field of heating, curing and drying systems, and in particular to heating, curing and drying systems where air is flowed from the ceiling or an end wall and past the object to be heated, dried or cured. More specifically, this disclosure relates to increasing airflow rates around an object.

SUMMARY

This disclosure provides a system for heating, drying or curing an object, the system comprising a housing having a first wall and at least one second wall adjacent the first wall. The first wall and at least one second wall define an interior for holding an object to be heated, dried or cured. The system also includes an air plenum adjacent to, covering and disposed inward from the first wall, and at least one air plenum opening in the air plenum to supply air into the interior. A fan is disposed in the one air plenum opening. The system also includes a ductwork assembly adjacent to, covering and disposed inward from the second wall. The ductwork assembly is in air-communication with the air plenum, and has a ductwork opening so that substantially all air circulation in the interior is between the air plenum opening and the ductwork opening.

Figure 1:
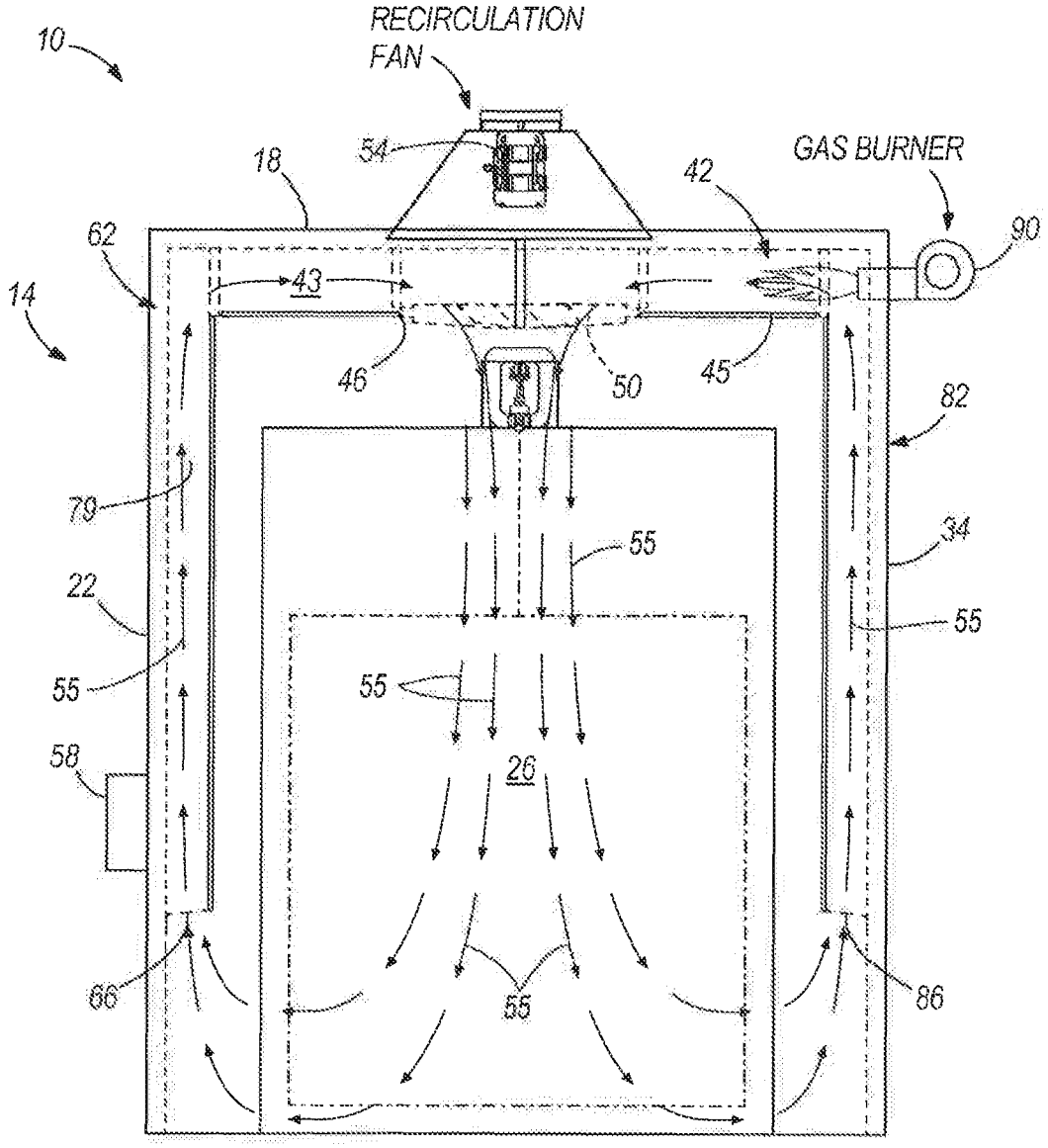
FIG. 1 is an end view of a system according to this disclosure, including a housing defining an interior for drying, heating or curing an object.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

As shown in the drawings, disclosed is a system 10 for heating, drying or curing an object or part (not shown) made of metal, wood, plastic, or some other material. For example, the system 10 can be used for object preheating, for paint drying, thermal degreasing, or for powder paint curing. The system 10 includes a housing 14 having a first wall 18 and at least one second wall 22 adjacent the first wall 18, the first wall 18 and at least one second wall 22 defining an interior 26 for holding an object to be heated, dried or cured. Wall as used herein refers to any housing planar surface, whether a ceiling, a floor, an end, or a side. More specific references include more specific wording.

Figure 2:
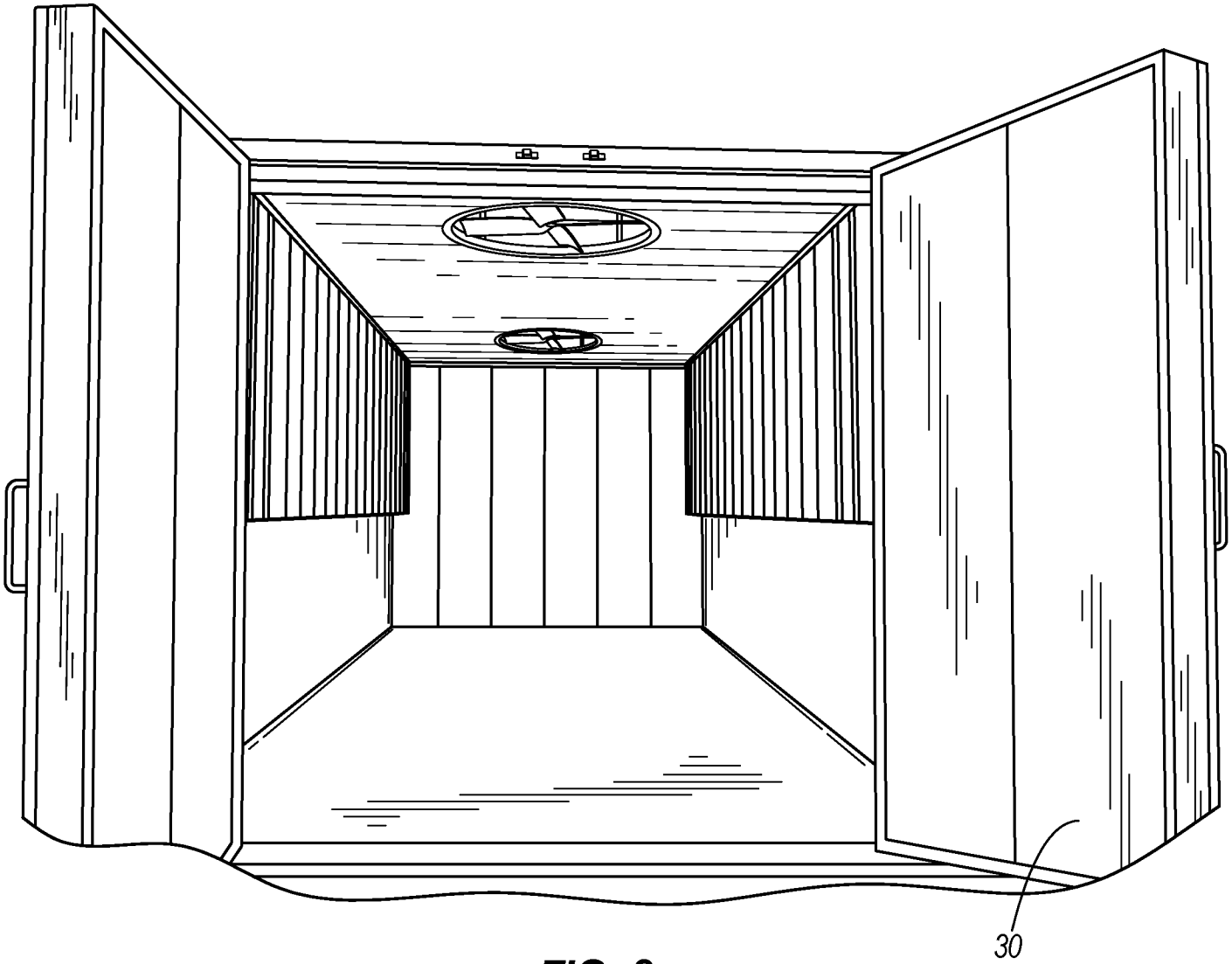
FIG. 2 is a perspective view of the system.

More particularly, the first wall is a ceiling 18, and the second wall is a side wall 22. Still more particularly, there is a door 30 (see FIGS. 2 and 3) to the interior of the housing 14, an opposite side wall 34, and a back wall 38, which together act to enclose the interior 26 of the housing and keep air within the housing 14. In other less preferred embodiments, the first wall can be a back wall, a floor, or a side wall. As an example, the housing outside dimensions can be 13 feet wide, 18 feet long, and 25 feet deep, but any size housing for heating, drying or curing an object is possible. In addition, the system can be part of a treatment process, where the housing does not include doors, but instead has product openings permitting the product to pass through the housing on a conveyor (not shown).

Figure 3:
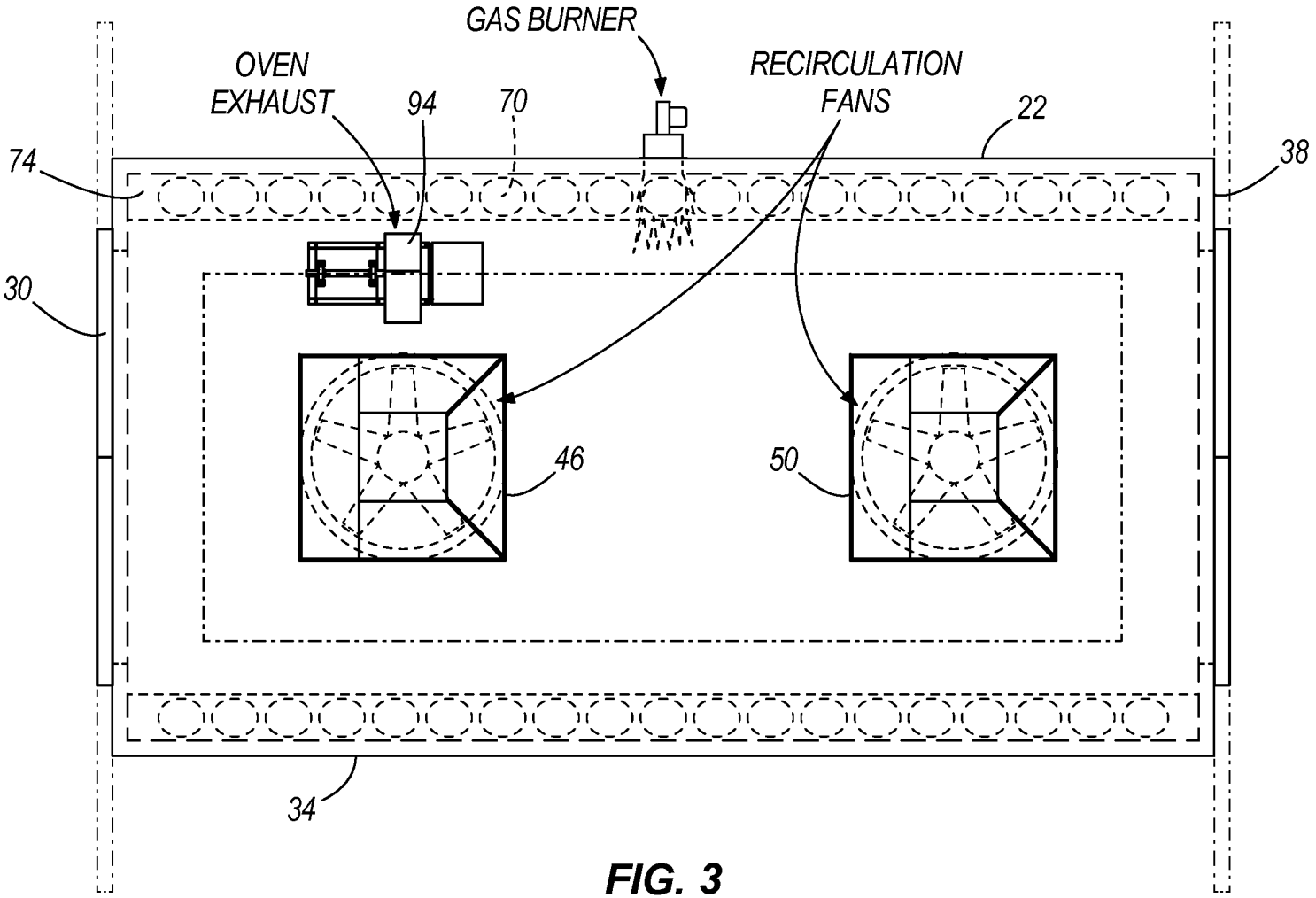
FIG. 3 is a top view of the system.
Figure 4:
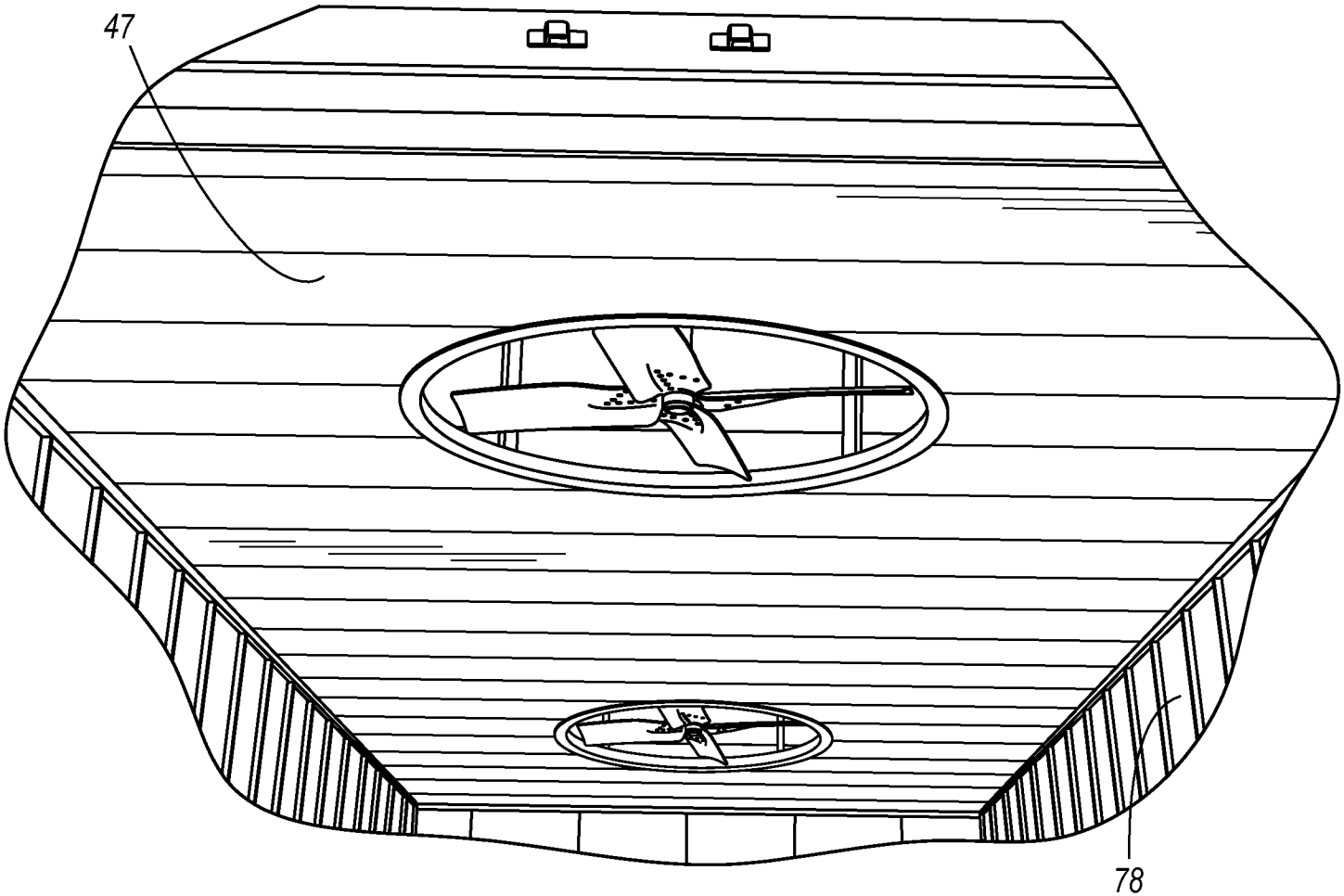
FIG. 4 is a perspective view of the ceiling in the system.

The system 10 also includes an air plenum 42 (see FIG. 1) adjacent to, covering and disposed inward from the ceiling 18, and at least one air plenum opening 46 in the air plenum to supply air into the interior 26. More particularly, in the illustrated embodiment, the system 10 includes two spaced apart air plenum openings 46 (see FIG. 3), and a fan 50 is disposed in each of the air plenum openings 46. The air plenum 42 substantially covers the ceiling 18, and insulates the housing interior 26 from the exterior of the housing 14. As illustrated in FIG. 1, the air plenum 42 has a space 43 formed between the housing ceiling 18 and a wall 45 formed by a plurality of adjacent connected panels 47 (see FIG. 4) spaced apart from the ceiling 18. As shown in FIGS. 3 and 4, the fan 50 substantially fills the air plenum opening 46, thereby creating a negative pressure in the air plenum 42 when the fan 50 forces air into the housing interior 26.

As illustrated in FIG. 1, an electric motor 54 drives the fan 50, and the fan 50 has a low speed and a high-speed, and more particularly, has variable speed, and is rotation direction reversible. In the disclosed embodiment, a programmable logic controller 58 is electrically connected to and controls the fan's electric motor 54. In other embodiments, the programmable logic controller can be omitted. For example, air can flow out of the air plenum 42 around the object in the housing interior 26. This permits a significant amount of heated air to pass over the object. In some instances, however, where less air contact with the object is desired, the direction of the fan 50 can be reversed, causing air to flow from around the object up into the air plenum 42. The programmable logic controller 58 permits an operator to control a number of different system parameters, such as fan speed, process temperature, direction, and whether the fan is on or off.

The fan 50 increases the air flows within the interior 26 in the vicinity of an object (not shown) to increase curing rates, for example, associated with a spray application on the object, or to enhance air flow over the object during a heating, drying or a cure cycle. The variable speed control of the fan 50 permits various amounts of airflow around the object. For example, when a powder coat is just beginning to gel, it may be advantageous to have limited airflow around the object. After the powder begins to gel, and becomes firmer, the fan speed can be increased, increasing the amount of airflow past the gel. This reduces the gel curing time.

Figure 5:
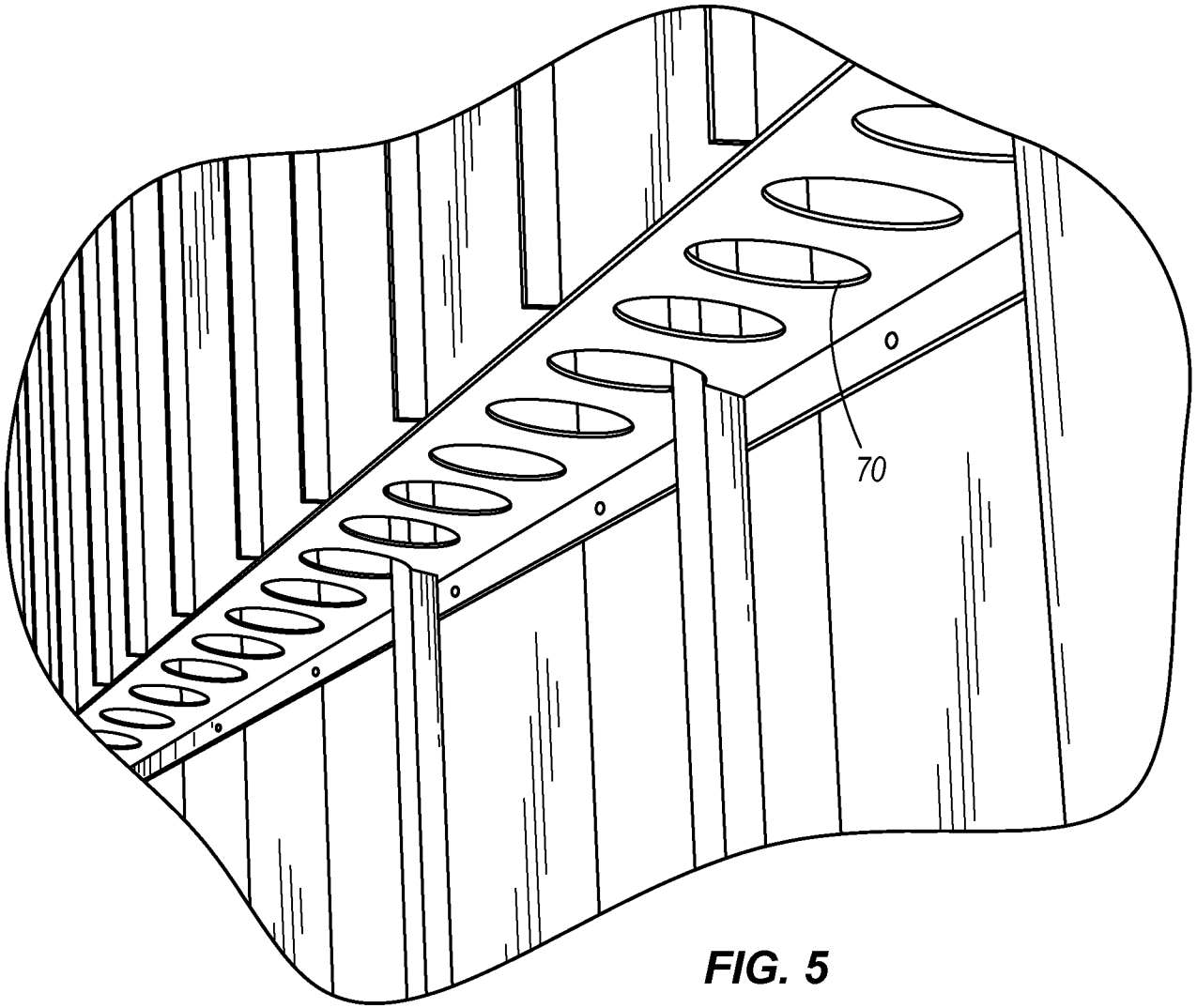
FIG. 5 is a perspective view of a ductwork assembly on the sidewall of the interior of the system.

The system 10 further includes a return plenum or ductwork assembly 62 adjacent to, covering and disposed inward from a second wall or side wall 22, the ductwork assembly 62 being in air-communication with the air plenum 42, and having a ductwork opening 66 so that substantially all air circulation 55 (see FIG. 1) in the housing interior 26 is between the air plenum openings 46 and the ductwork opening 66. In other less preferred embodiments, the second wall can be a ceiling, a floor, or an end wall. Opening as used herein means any opening permitting airflow from the ductwork assembly or air plenum into the oven interior. In the disclosed embodiment, as illustrated in FIGS. 3 and 5, the ductwork opening 66 is a plurality of holes 70 in a nozzle plate 74, but in other less preferred embodiments (not shown), it can be a single opening in the ductwork, or a nozzle or a plurality of nozzles, for example.

As illustrated in FIG. 1, the ductwork assembly 62 covers at least the upper half of the side wall 22, and provides an insulating barrier between the interior 26 and the exterior of the housing 14. The ductwork assembly 62 is formed in a conventional fashion from a plurality of adjacent connected panels 78 (see FIG. 4) attached to each other to form a single enclosure, although any manner of forming the return plenum is within the scope of this disclosure. The ductwork assembly includes a space 79 formed between the panels 78 and the side wall 22. In the preferred embodiment, there is also a similar second ductwork assembly 82 with a second ductwork opening 86 on the opposite housing side wall 34.

A heat source, such as an electric heater (not shown) or a gas heater 90 is disposed within the air plenum 42 in the housing side wall 34, and serves to heat the air and allow the system 10 to act as an industrial oven. In such instances, all walls and the air plenum and ductwork assembly are made from metal, in order to be compatible with the heated air. The system 10 further includes an oven exhaust 94 (see FIG. 3) above the ceiling 18 and in communication with the housing interior 26 and the housing exterior in order to remove cooled air from the system 10. In other embodiments, the oven exhaust can be omitted.

The disclosed system 10 significantly increases the curing efficiency of a conventional industrial oven used to cure powder coating on metal, wood, plastic and other substrates. The system allows for low airflow during the gel period of powder coating, and then progressively increases the airflow, through the bake cycle, to allow for a nearly perfect cure.

The system 10 also aids in the drying of a product after the aqueous washing of a product. The system significantly increases the amount of air and turbulence delivered to the product. This increases the drying efficiency. In an instance where the system is used as a preheat oven, the system allows for a more uniform product temperature profile as the heat up rates for the different thicknesses are enhanced.

The system 10, in the preferred embodiment, is designed with variable frequency drives to allow the operator to pick a recipe, thus reducing the airflow thru the gel cycle. This allows the powder paint to set, prior to the full cure and required "Time at temperature" process parameters.

The system 10 is supplied with return plenums on each side and the roof of the chamber. These plenums are designed to capture the conventional heat losses through the walls and roof. This significantly increases the temperature uniformity within the oven chamber as the interior now includes a "Hot Wall" in lieu of the conventional "Cold Wall". The system, including the fan layout and type, allows for a much greater amount of air delivered to a product as compared to a conventional oven. This increased airflow significantly increases the uniformity and heat transfer to the process and the customer's product. The system, by design, does not have ductwork on the positive side of the fan. As a result of this feature, the chamber is completely free of ductwork on the floor, thus allowing for the cleaning of the equipment, to be more efficient.

The oven control system, when programmable logic controller based, is designed to allow the operator to pick a recipe to provide the "optimum" process schedule. This a custom program with data acquisition to provide constant feed back of the oven performance. Additionally, through an operator interface, the operator can set the temperature, low flow, high flow, cycle times and process parameters.

Conventional systems having forced air ducts with circulating fans cause significant pressure drops across the air circulation system. This results in the need for higher horsepower fans, and increases in the cost of operating the system. In the system 10, substantially less horsepower is needed to circulate the same or even a greater amount of air, so improvements in energy efficiency of at least 50 percent over conventional systems is possible.

Various other features of this disclosure are set forth in the following claims.

The invention claimed is:

1. A system comprising:

a housing having:

a first side wall having an upper edge and a lower edge, a second side wall opposite the first side wall, the second side wall having an upper edge and a lower edge, and a ceiling extending between the upper edge of the first side wall and the upper edge of the second side wall, wherein a first volume is defined between the first side wall, the second side wall, and the ceiling;

an air plenum, wherein the air plenum has a plenum wall disposed into the first volume from the ceiling, wherein a second volume is defined between the ceiling and the plenum wall and the air plenum includes at least one air plenum opening in the plenum wall extending between the second volume and a chamber, the chamber configured to hold an object to be heated, dried or cured;

a fan disposed in the at least one air plenum opening to draw air from the second volume and deliver air into the chamber through the at least one air plenum opening;

a first ductwork assembly disposed into the first volume from the first side wall, the first ductwork assembly defining a first ductwork volume, wherein the first ductwork volume is in air-communication between the chamber and the second volume and wherein the first ductwork assembly includes at least one first ductwork opening extending between the chamber and the first ductwork volume; and a second ductwork assembly disposed into the first volume from the second side wall, the second ductwork assembly being arranged within the housing parallel to the first ductwork assembly and defining a second ductwork volume, wherein the second ductwork volume is in air-communication between the chamber and the second volume and wherein the second ductwork assembly includes at least one second ductwork opening extending between the chamber and the second ductwork volume, wherein substantially all air circulation in the chamber is between the at least one air plenum opening and a combination of the at least one first ductwork opening and the at least one second ductwork opening.

2. A system as in claim 1, wherein the at least one fan has a low speed and a high-speed.

3. A system as in claim 2, wherein the at least one fan has variable speed.

4. A system as in claim 3, and further including a programmable logic controller electrically connected to the fan to permit variable operation of the tan.

5. A system as in claim 1, wherein the chamber is sufficient to be used for at least one of object preheating, object paint drying, object thermal degreasing, and object powder paint curing, and wherein the at least one fan is rotation direction reversible.

6. A system as in claim 1, wherein the air plenum covers the entire ceiling.

7. A system as in claim 1, wherein the first ductwork assembly covers at least the upper half of the first side wall and the second ductwork assembly covers at least the upper half of the second side wall.

8. A system as in claim 1, wherein the fan is operable to locally increase air flows within the chamber in the vicinity of the object to increase curing rates associated with a spray application on the object, and to enhance air flow over the object during heating, drying or a curing.

9. A system as in claim 1, wherein a heater is disposed within the air plenum.

10. A system as in claim 9, wherein the heater is a gas burner.

11. A system as in claim 1, wherein the first ductwork assembly provides an insulating barrier between the chamber and the first side wall, the second ductwork assembly provides an insulating barrier between the chamber and the second side wall, and the air plenum provides an insulating barrier between the chamber and the ceiling.

12. A system for heating, drying or curing an object, the system comprising:

a housing including:

a first wall having a first height, a second wall having a second height, the second wall opposite the first wall, and a ceiling extending longitudinally between the first and second walls, wherein a first volume is defined by the first wall, the second wall, and the ceiling;

an air plenum including a plenum wall having a periphery defined by a front edge, a rear edge, a first side edge, and a second side edge, wherein:

the plenum wall is displaced from the ceiling into the first volume, a plenum air volume is defined between the ceiling and the plenum wall, and at least one air plenum opening is located in the plenum wall;

a fan disposed in the at least one air plenum opening;

a first ductwork assembly including a first ductwork wall having a periphery defined by a front edge, a rear edge, a lower edge, and an upper edge, wherein:

the first ductwork wall is displaced from the first wall into the first volume, the first ductwork wall has a third height, the third height less than the first height, a first return air volume is defined between the first ductwork wall and the first wall, and the upper edge of the first ductwork wall is joined to the first side edge of the air plenum wall;

a second ductwork assembly including a second ductwork wall having a periphery defined by a front edge, a rear edge, a lower edge, and an upper edge, wherein:

the second ductwork wall is displaced from the second wall into the first volume, the second ductwork wall has a fourth height the fourth height less than the second height, a second return air volume is defined between the second ductwork wall and the second wall, and the upper edge of the second ductwork wall is joined to the second side edge of the air plenum wall; and an open volume configured to hold an object to be heated, dried or cured, wherein;

the open volume is defined, at least in part, by a lower surface of the plenum wall, an inner surface of the first ductwork wall, and an inner surface of the second ductwork wall, the open volume is in air-communication with the plenum air volume via the at least one air plenum opening, the open volume is in air-communication with the first return air volume via at least one first ductwork opening in the first ductwork assembly, the open volume is in air-communication with the second return air volume via at least one second ductwork opening in the second ductwork assembly, and the open volume includes no additional ductwork to carry air between the air plenum opening and either of the at least one first ductwork opening or the at least one second ductwork opening.

13. The system of claim 12 wherein the fan delivers air from the plenum air volume to the open volume through the at least one air plenum opening.

14. The system of claim 1 wherein no ductwork is present to carry air between the air plenum opening and either of the at least one first ductwork opening or the at least one second ductwork opening.

15. A system comprising:

a housing having:

a first side wall having an upper edge, a lower edge, and a first height corresponding to a distance between the lower edge and the upper edge;

a second side wall opposite the first side wall, the second side wall having an upper edge, a lower edge, and a second height corresponding to a distance between the lower edge and the upper edge of the second side wall;

a ceiling extending between the upper edge of the first side wall and the upper edge of the second side wall, and a floor extending between the lower edge of the first side wall and the lower edge of the second side wall, wherein a first volume is defined between the first side wall, the second side wall, the ceiling, and the floor;

an air plenum, wherein the air plenum has a plenum wall disposed into the first volume from the ceiling, wherein a second volume is defined between the ceiling and the plenum wall and the air plenum includes at least one air plenum opening in the plenum wall extending between the second volume and a chamber, the chamber configured to hold an object to be heated, dried or cured;

a fan disposed in the at least one air plenum opening to draw air from the second volume and deliver air into the chamber through the at least one air plenum opening;

a first ductwork assembly disposed into the first volume from the first side wall, the first ductwork assembly extending from the plenum wall toward the floor for a distance less than the first height and defining a first ductwork volume, wherein the first ductwork volume is in air-communication between the chamber and the second volume and wherein the first ductwork assembly includes at least one first ductwork opening extending between the chamber and the first ductwork volume; and a second ductwork assembly disposed into the first volume from the second side wall, the second ductwork assembly extending from the plenum wall toward the floor for a distance less than the second height and defining a second ductwork volume; wherein the second ductwork volume is in air-communication between the chamber and the second volume and wherein the second ductwork assembly includes at least one second ductwork opening extending between the chamber and the second ductwork volume, wherein substantially all air circulation in the chamber is between the at least one air plenum opening and a combination of the at least one first ductwork opening and the at least one second ductwork opening.

16. A system as in claim 15, and further including a programmable logic controller electrically connected to the fan to permit variable operation of the fan.

17. A system as in claim 15, wherein the chamber is sufficient to be used for at least one of object preheating, object paint drying, object thermal degreasing, and object powder paint curing, and wherein the at least one fan is rotation direction reversible.

18. A system as in claim 15, wherein the air plenum covers the entire ceiling.

19. A system as in claim 15, wherein the first ductwork assembly covers at least the upper half of the first side wall and the second ductwork assembly covers at least the upper half of the second side wall.

20. A system as in claim 15, wherein the fan is operable to locally increase air flows within the chamber in the vicinity of the object to increase curing rates associated with a spray application on the object, and to enhance air flow over the object during heating, drying or a curing.

21. A system as in claim 15, wherein a heater is disposed within the air plenum.

* * * * *